US005331301A

United States Patent [19]

Glennon et al.

[11] Patent Number: 5,331,301

[45] Date of Patent: * Jul. 19, 1994

[54] CIRCUIT BREAKER

[75] Inventors: Oliver Glennon; James Early, both of Ballinasloe; James Shortt, Malahide; Martin F. Healy, Ballinasloe, all of Ireland; Hendrik A. Bosch, Hengelo; Soedjiemat F. Darmohoetomo, Surinam, both of Netherlands; Raymond Burke, Ballinasloe, Ireland

[73] Assignee: Square D Company, Palatine, Ill.

[ * ] Notice: The portion of the term of this patent subsequent to Feb. 18, 2009 has been disclaimed.

[21] Appl. No.: 768,270

[22] PCT Filed: Jan. 21, 1991

[86] PCT No.: PCT/US91/00380

§ 371 Date: Oct. 21, 1991

§ 102(e) Date: Oct. 21, 1991

[51] Int. Cl.[5] ..... H01H 83/00

[52] U.S. Cl. ..... 335/20; 335/14

[58] Field of Search ..... 335/6, 18, 17, 14, 20, 335/21, 167-176; 361/42-50

[56] References Cited

U.S. PATENT DOCUMENTS 5,089,796 2/1992 Glennon et al. ..... 335/172

*Primary Examiner*—Lincoln Donovan

*Attorney, Agent, or Firm*—Larry I. Golden; Kareem M. Irfan

[57] ABSTRACT

A residual current circuit breaker 1 has a partition wall 3 which separates an over-current protection device 4 from a residual current detection circuit 5. A plunger rod 24 extends through a bore 23 in the armature 21 of a coil 20 and is moved independently through the coil 20 to trip the breaker if a residual current is detected by the circuit 5. The plunger rod 24 is moved by a drive rod 31, the operation of which is controlled by a permanent magnet which retains the drive rod 31 retracted and an electromagnet which allows the drive rod 31 to drive forwardly under the action of a spring 32 in the event of a residual current being detected. The plunger rod 30 is reset by a reset lever 40 which is moved when an operating handle 18 of the breaker moves from a non-tripped to a tripped position on tripping of the breaker.

19 Claims, 5 Drawing Sheets

CIRCUIT BREAKER

TECHNICAL FIELD

The invention relates to circuit breakers and in particular to circuit breakers of the type having both over-current and earth leakage protection, commonly referred to as residual current circuit breakers (RCCB's).

PRIOR ART

Over-current protective devices have limitations such as delay in operation in situations where there is a relative high earth loop impedance. Further, over-current protective devices do not detect earth fault currents below their operating current, which currents in certain circumstances may constitute a fire hazard. Accordingly, there is an increasing demand for protective devices providing both over-current and earth leakage protection.

SUMMARY OF THE INVENTION

It is an object of the invention to provide a residual current circuit breaker which is reliable in operation and relatively simple to manufacture.

According to one aspect, the invention provides a circuit breaker for use in a system having live, neutral and ground leads, comprising:

a housing;

a breaker assembly in the housing for making and breaking an electrical connection between a movable contact and a stationary contact;

an operating handle for the breaker assembly;

an over-current sensing means for tripping of said breaker assembly; the over-current sensing means including a coil and an armature core in the coil; the armature core having an axial bore extending therethrough;

and an additional tripping mechanism;

the additional tripping mechanism comprising:

a plunger means mounted within the axial bore of the armature core;

an actuating device for controlling the movement of the plunger means from a non-tripping position to a tripping position;

the plunger means being independently movable through the axial bore in the armature core when moving between the non-tripping and tripping positions, and reset means being provided for re-setting of the plunger means to the non-tripping position.

In a particularly preferred aspect the circuit breaker is a residual current circuit breaker and includes a residual current detection circuit for detection of a residual current in the system, and the actuating device comprises a residual current actuating device for controlling the movement of the plunger means between a non-tripping position and a tripping position when a residual current fault is detected by the detection circuit.

In one embodiment of the invention the actuating device comprises a drive rod which is movable on detection of a residual current fault between a non-tripping position and a tripping position in which the drive rod engages the plunger means to drive the plunger means into the tripping position, biassing means for urging the drive rod into a tripping position, and retaining means for retaining the drive rod in a non-tripping position.

Preferably the retaining means comprises a permanent magnet to hold the drive rod in the non-tripping position and electromagnet to neutralise the effect of the permanent magnet on the drive rod on detection of a residual current fault.

In one arrangement the biassing means comprises a spring means for driving the drive rod into a tripping position engaging the plunger.

Preferably the reset means comprises a reset lever interposed between the drive rod and the plunger and a reset actuator for moving the lever to return the drive rod into the non-tripping position against the action of the biassing means.

In a preferred arrangement the reset actuator comprises the circuit breaker operating handle which engages the reset lever when the handle is moved from the on or non-tripped position with the contacts closed to the off or tripped position with the contacts opened.

Preferably the reset lever is pivotally mounted to the housing intermediate the ends thereof and comprises a first lever arm for engagement by the operating handle and a second lever arm interposed between the drive rod and the plunger means. Typically the reset lever is of substantially L shape in plan view.

In a preferred embodiment of the invention the plunger means comprises a single plunger rod extending through the bore in the armature core. Preferably the plunger rod is of non-ferrous, preferably plastics material.

In one embodiment of the invention engagement means are provided intermediate the ends of the plunger rod for engagement by the armature core on movement of the armature core in the event of an overcurrent fault occurring from a non-tripping position in which the armature core is retained by a spring biassing means to a tripping position in which current flowing through the coil draws the armature core through the coil against the biassing of the spring means to engage the plunger rod and trip the breaker assembly in the event of an overcurrent fault occurring. Preferably the engagement means is provided at substantially the mid point along the longitudinal axis of the plunger rod so that the rod is substantially symmetrical.

In one arrangement the engagement means comprises a radially outwardly extending collar engagable in a complementary shaped recess in the armature core.

Preferably the plunger rod is slidably mounted in a bushing provided in the coil at the end thereof remote from the armature core.

In another embodiment of the invention the actuating device comprises a solenoid.

In a further embodiment of the invention the actuating device is operated from a remote location.

In one embodiment of the invention position sensing means are provided for sensing the position of the plunger means.

Preferably the position sensing means comprises switch means operated by the plunger means on movement between the non-tripped and tripped position.

The invention will be more clearly understood from the following description of some preferred embodiments thereof given by way of example only with reference to the accompanying drawings in which.

Figure 1:
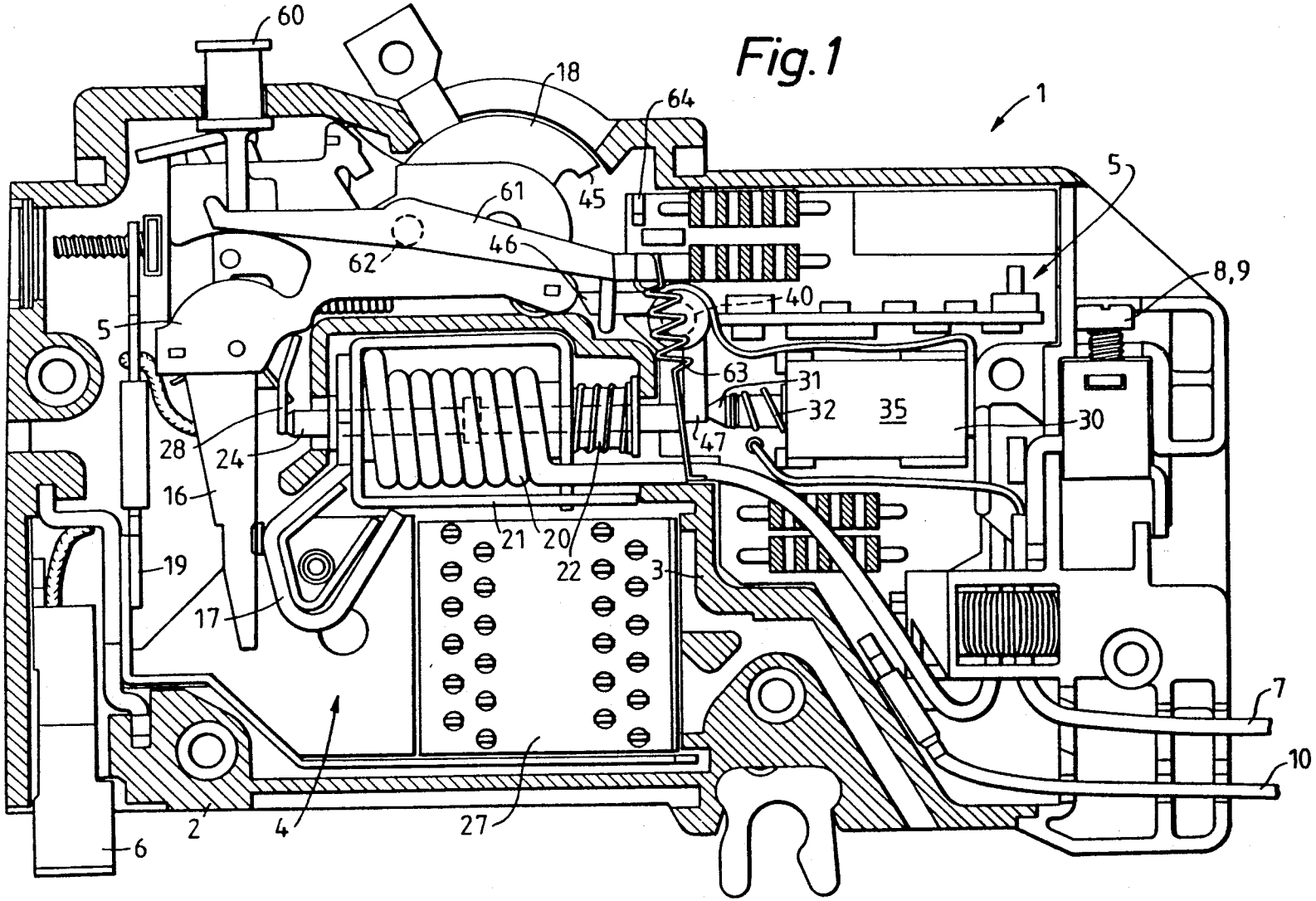
FIG. 1 is a plan view of a circuit breaker according to the invention.
Figure 2:
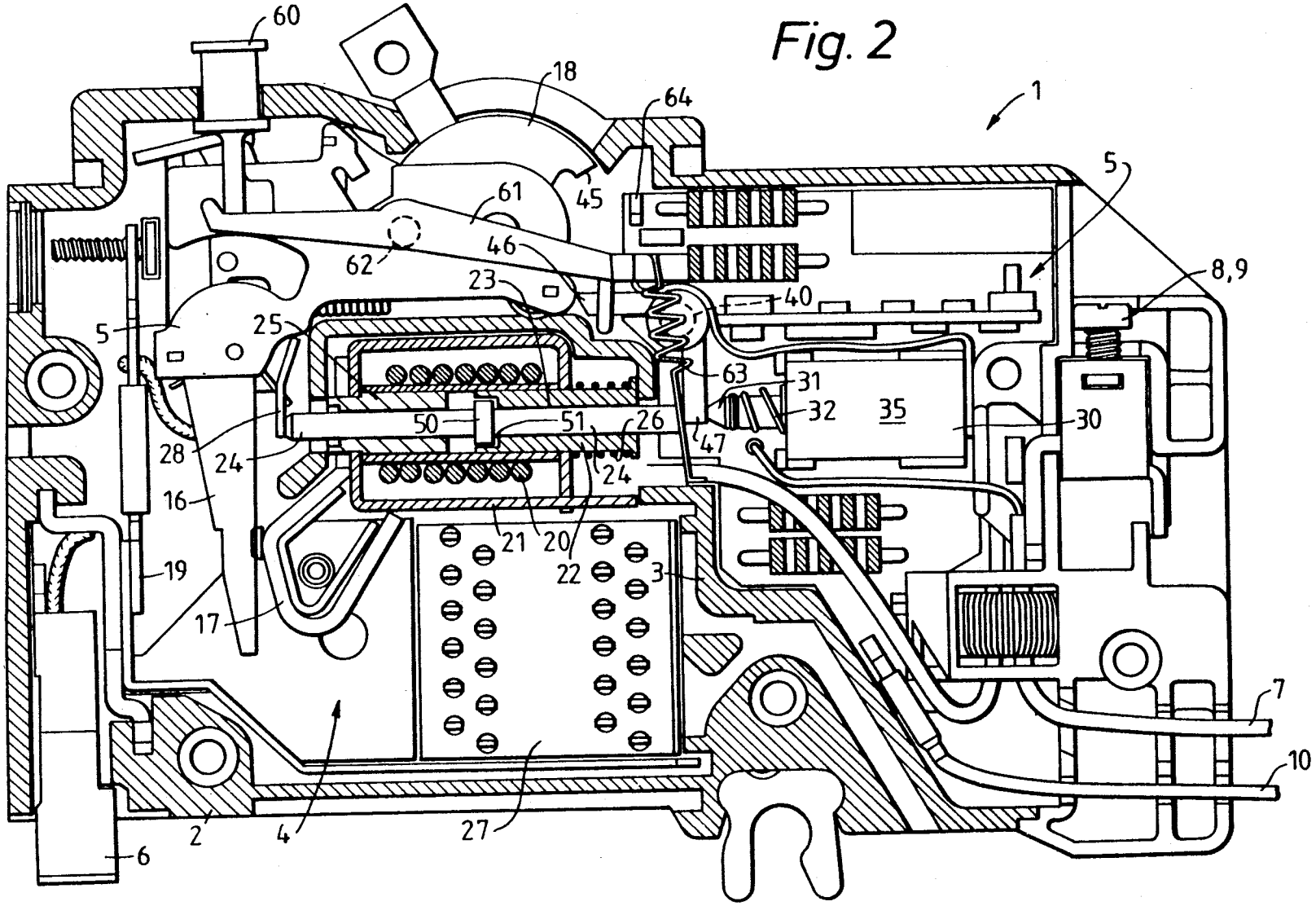
FIG. 2 is a plan, partially cross-sectional view of the circuit breaker of FIG. 1.
Figure 3:
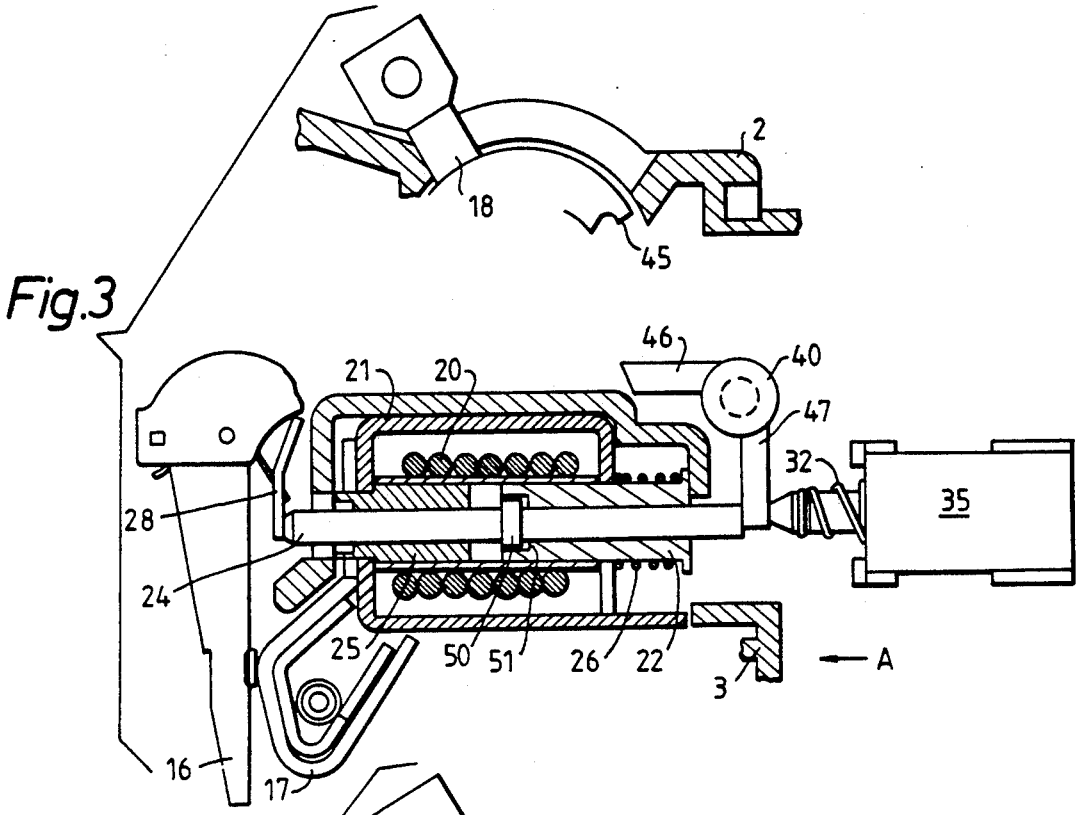
FIG. 3 is a cross-sectional view of a tripping portion of the circuit breaker in an on position.

Referring to the drawings, and initially to FIGS. 1 to 3 there is illustrated a circuit breaker in this case a residual current circuit breaker ( RCCB ) according to the invention indicated generally by the reference numeral 1. The RCCB 1 comprises a housing 2 having a base and a cover which form a partition wall 3 which separates an over-current protection device 4 from an additional tripping means which in this case includes a residual current detection circuit 5. The RCCB 1 includes line and neutral supply terminals 6 and 7, and neutral line load terminals 8 and 9, and an earth terminal 10. In this case, the line supply terminal 6 is formed by a metal clip for both mechanical and electrical connection with a supply conductor. The line and neutral load terminals 8 and 9 are of the screw-type and are in side-by-side relationship in a side wall of the housing 2. The neutral supply terminal 7 and the earth terminal 10 are of the conventional cable type.

The RCCB 1 includes a breaker assembly 15 which in this case is of the unitary type and includes a movable contact 16 for engagement with a fixed contact 17. The breaker assembly 15 also includes an operating handle 18 of conventional construction. The over-current protecting device 4 comprises a bi-metal element 19 abutting the breaker assembly 15 and an arc stack 27 of conventional construction. The device 4 also comprises a coil 20 having an armature 21 and having an armature core 22 which is biassed into a non-tripping position illustrated in FIGS. 1 and 2 by a coil spring 26. An axial bore 23 extends through the core 22.

The additional tripping means which in this case operates in response to a residual current fault occurring includes a plunger means comprising a single plunger rod 24 which extends through the partition wall 3, through the bore 23 and through a plunger bushing 25 to impact against a trip lever 28 of the breaker assembly 15 for moving the contact 16 away from the contact 17 to trip the breaker. The additional tripping means includes the residual current detection circuit 5 and an actuating device 30 for controlling the movement of the plunger rod 24 between a non-tripping position and a tripping position when a residual current fault is detected by the detection circuit. The actuating device 30 comprises a drive rod 31 which is movable on detection of a residual current fault to engage and drive the plunger rod 24 through the bore 23 to trip the breaker. The drive rod 31 is biassed into a forward or tripping position by a coil spring 32 wound around the rod 31. Retaining means for retaining the drive rod 31 in a non-tripping or retracted position comprises a magnetic assembly 35 comprising a permanent magnet to hold the drive rod 31 in a non-tripping position and an electromagnet to neutralise the effect of the permanent magnet on the drive rod 31 on detection of a residual current fault by the circuit 5.

The plunger rod 24 is in this case of non-ferrous, preferably plastics material. The rod 24 includes an engagement means in the form of a radially outwardly extending collar 50 which is engagable in a complementary shaped recess in the armature core 22. The collar 50 is provided substantially at the mid-point along the longitudinal axis of the plunger rod 24 so that the rod 24 is substantially symmetrical. Thus, on assembly, the rod 24 may be inserted into the bore 23 in either direction.

Reset means for re-setting of the plunger rod 24 to a non-tripping position comprises a reset lever 40 interposed between the drive rod 31 and plunger rod 34 and a reset actuator for moving the lever rod 40 to return the drive rod 31 into the non-tripping position against the action of the spring 32. In this case the reset actuator comprises the circuit breaker operating handle 18 which includes an engagement surface 45 which engages against the reset lever 40 when the handle 18 is moved from the on or non-tripped position with the contacts 16, 17 closed to the off or tripped position with the contacts 16, 17 open.

The reset lever 40 is pivotally mounted to the housing 2 intermediate the ends thereof, is of generally 'L' shape in plan view and comprises a first arm 46 for engagement by the engagement surface 45 of the operating handle 18 and a second arm 47 interposed between the drive rod 31 and plunger rod 24.

A test mechanism for checking the operation of the residual current tripping device comprises a test button 60 engagable against a lever 61 which is pivotally mounted to the housing 2 by a pivot pin 62. A spring 63 biasses the lever 61 into the non-test position illustrated in FIGS. 1 and 2. The spring 63 is electrically connected to the coil 20 at one end and the lever 61 is arranged to move the other end of the spring 63 between a non-test position as illustrated in FIGS. 1 and 2 to a test position in contact with a push to test terminal 64.

Figure 4:
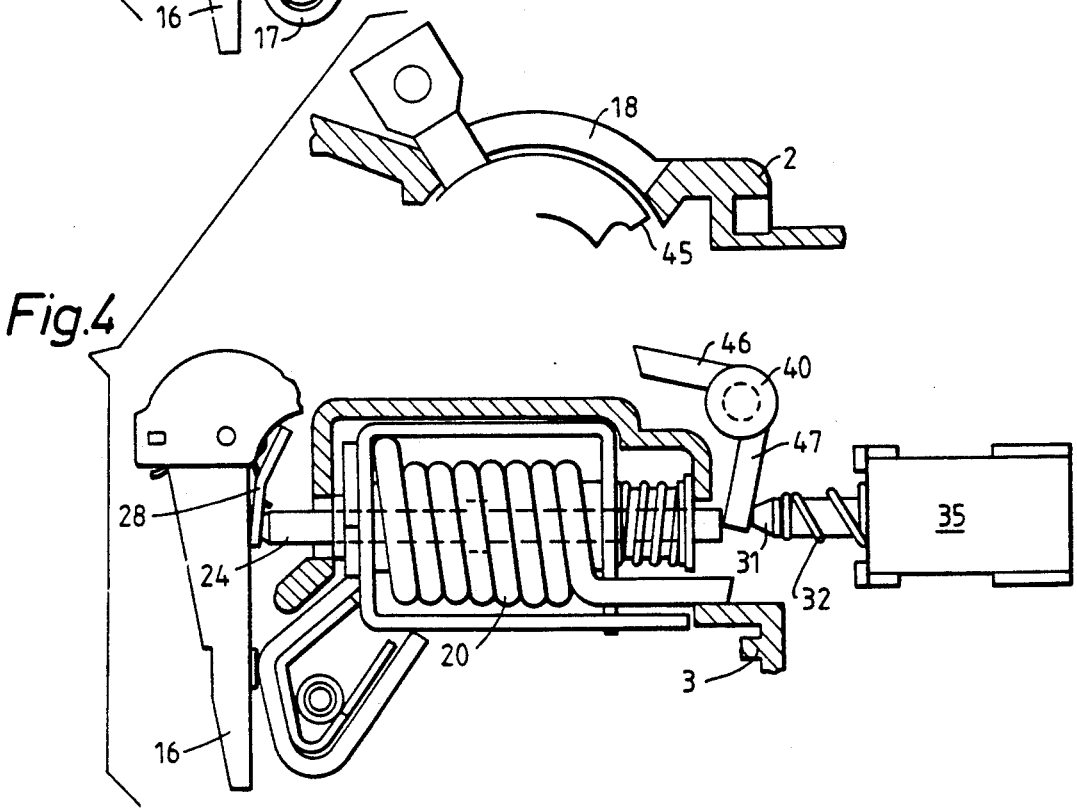
FIGS. 4 to 7 are plan views of the tripping position in different positions.
Figure 5:
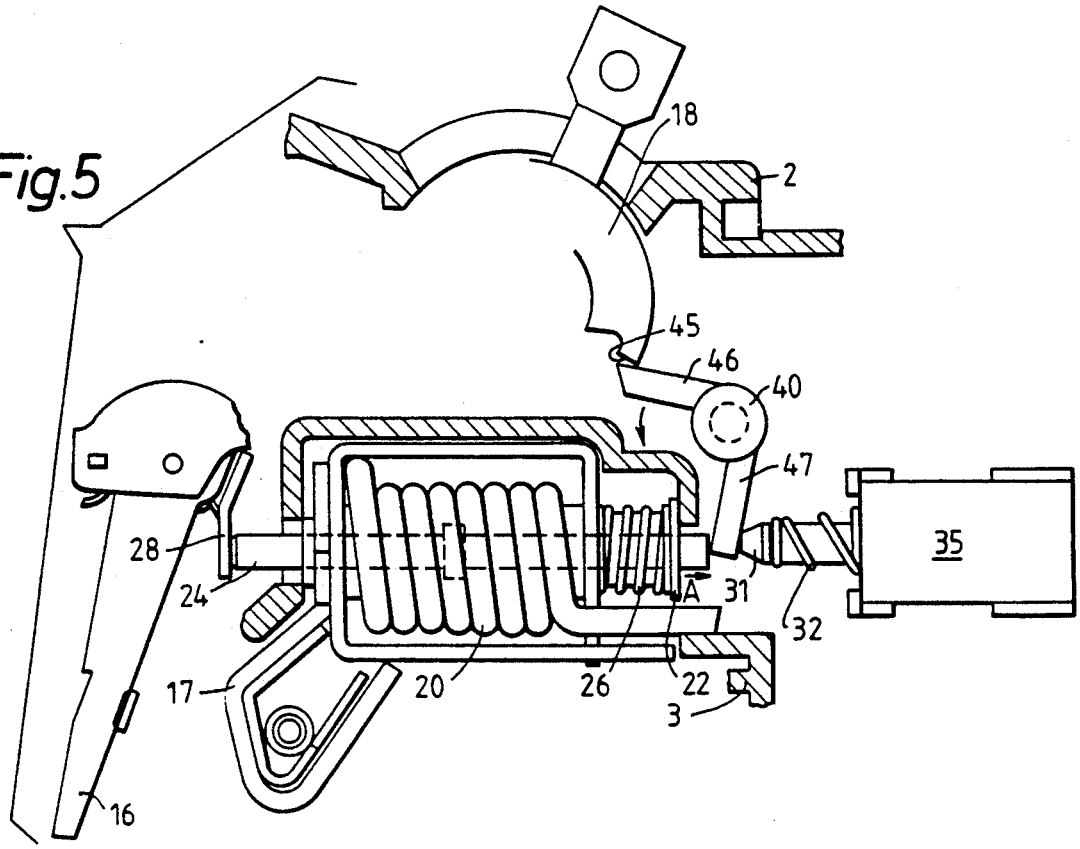
Figure 6:
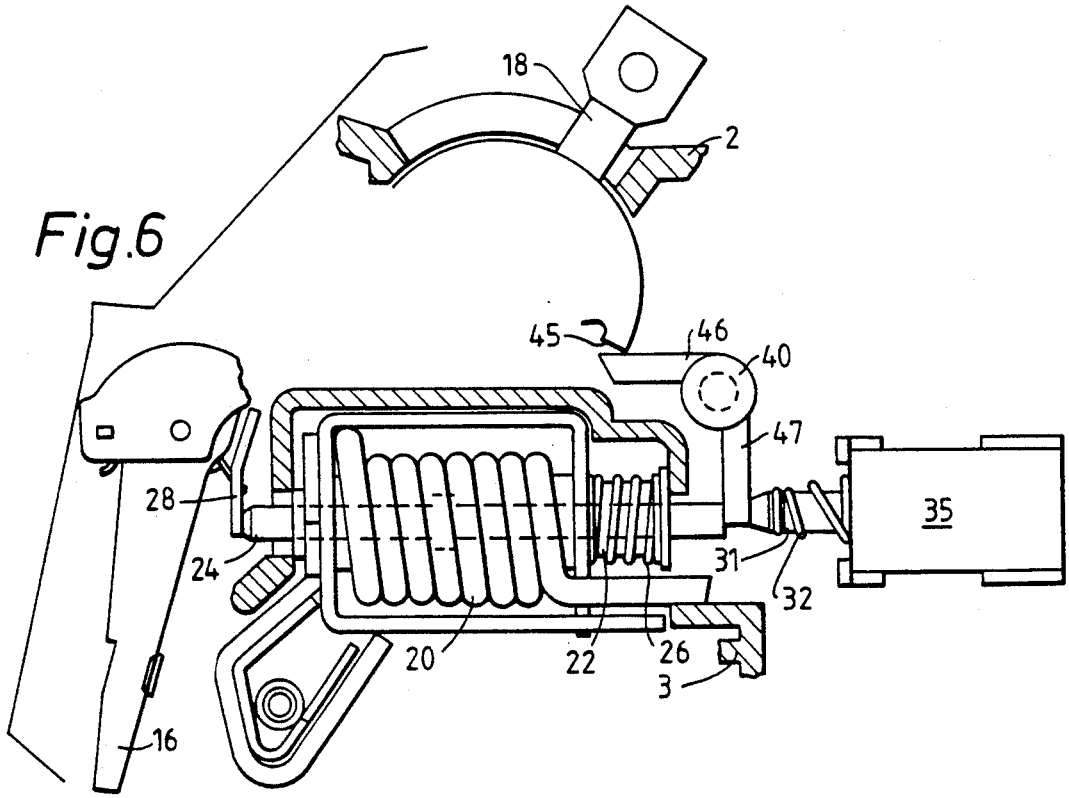

In use, and referring particularly to FIGS. 3 to 7 in the normal non-tripped position illustrated in FIG. 3 the handle 18 is in the on position, the drive rod 31 is retracted, the reset lever 40 is at right angles to the drive rod 31, the armature core 22 is retracted, the plunger rod 24 is retracted and the contacts 16, 17 are closed. In the event of a residual current fault being detected by the circuit 5 the electromagnet of the magnetic assembly 35 is activated to neutralise the effect of the permanent magnet restraining the drive rod 31, allowing the rod 31 to extend outwardly under the action of the spring 32, striking the lever arm 47 of the reset lever 40 forwardly about its pivot to strike the plunger rod 24 which moves independently through the bore 23 of the armature core 22 to strike the lever 28. This configuration is illustrated in FIG. 4. The striking of the lever 28 releases a spring which moves the contact 16 away from the contact 17 and the handle 18 is thrown towards the off position as illustrated in FIG. 5.

As the handle 18 travels into the off position the engagement surface 45 of the handle 18 strikes the arm 46 of the reset lever 40 as illustrated in FIG. 5, pivoting the lever 40 anticlockwise and thus pushing the arm 47 of the reset lever 40 against the plunger rod 31 driving it back into the magnetic assembly housing against the biassing of the spring 32. The plunger rod 24 is then free to move back through the bore into the reset position illustrated in FIG. 6. When the handle 18 is thrown back into the on position the additional tripping device is in the non-tripping position illustrated in FIG. 3.

Figure 7:
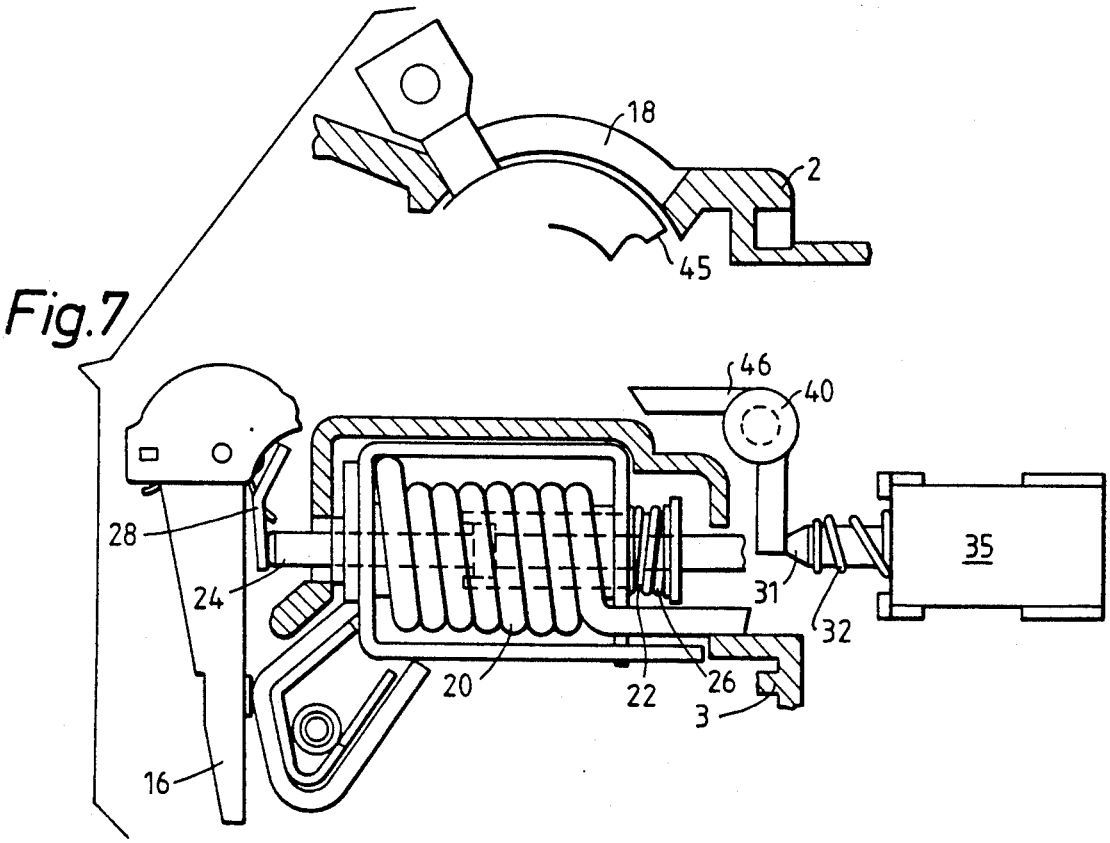

Referring to FIG. 7 in the event of an overcurrent fault developing the armature core 22 is drawn into the coil 20 against the biassing of the spring 26, the recess 51 of the core 22 engaging with the collar 50 on the plunger rod 24 to drive the plunger rod 24 forward through the coil 20 to trip the breaker by striking the lever 28.

One advantage of the breaker of the invention is that because the plunger means is independently movable through the armature core it performs the function of tripping the breaker independently of the armature core. There is no magnetic interference between the trip mechanism via movement of the armature core in the event of an overcurrent fault and movement of the plunger means in the event of a residual current fault. Further, the plunger means may be used in association with a position sensing means such as an auxiliary switch to give a remote indication of the closed or open status of the breaker. The position sensing means may detect the position of the contacts directly or indirectly by sensing the position of the plunger.

Auxiliary and command devices either locally or remotely operated may be used as an alternative to the residual current detection circuit to provide a tripping signal in the event of a fault or test condition occurring.

It will be appreciated that the invention provides an RCCB which is relatively simple and is reliable in operation. The use of a separate drive rod 31 and impact rod 32 allows the choice of suitable materials, in this case a plastics impact rod and ferrous drive rod. Further, re-setting is relatively simple as a hand-controlled lever may be easily used.

We claim:

1. A circuit breaker for use in a system having live, neutral and ground leads, comprising:

a housing;

a breaker assembly in the housing for making and breaking an electrical connection between a movable contact and a stationary contact;

an operating handle for the breaker assembly;

an over-current sensing means for tripping of said breaker assembly; the over-current sensing means including a coil and an armature core in the coil; the armature core having an axial bore extending therethrough;

and an additional tripping mechanism;

the additional tripping mechanism comprising:

a plunger means mounted within the axial bore of the armature core;

an actuating device for controlling the movement of the plunger means from a non-tripping position to a tripping position;

the plunger means being independently movable through the axial bore in the armature core when moving between the non-tripping and tripping positions, and reset means being provided for re-setting of the plunger means to the non-tripping position.

2. A circuit breaker as claimed in claim 1 wherein the breaker includes a residual current detection circuit for detection of a residual current in the system, and the actuating device comprises a residual current actuating device for controlling the movement of the plunger means between a non-tripping position and a tripping position when a residual current fault is detected by the detection circuit.

3. A circuit breaker as claimed in claim 2 wherein the actuating device comprises a drive rod which is movable on detection of a residual current fault between a non-tripping position and a tripping position in which the drive rod engages the plunger means to drive the plunger means into the tripping position, biassing means for urging the drive rod into a tripping position, and retaining means for retaining the drive rod in a non-tripping position.

4. A circuit breaker as claimed in claim 3 wherein the retaining means comprises a permanent magnet to hold the drive rod in the non-tripping position and electromagnet to neutralise the effect of the permanent magnet on the drive rod on detection of a residual current fault.

5. A circuit breaker as claimed in claim 3 wherein the biassing means comprises a spring means for driving the drive rod into a tripping position engaging the plunger.

6. A circuit breaker as claimed in claim 3 wherein the reset means comprises a reset lever interposed between the drive rod and the plunger and a reset actuator for moving the lever to return the drive rod into the non-tripping position against the action of the biassing means.

7. A circuit breaker as claimed in claim 6 wherein the reset actuator comprises the circuit breaker operating handle which engages the reset lever when the handle is moved from the on or non-tripped position with the contacts closed to the off or tripped position with the contacts opened.

8. A circuit breaker as claimed in claim 7 wherein the reset lever is pivotally mounted to the housing intermediate the ends thereof and comprises a first lever arm for engagement by the operating handle and a second lever arm interposed between the drive rod and the plunger means.

9. A circuit breaker as claimed in claim 8 wherein the reset lever is of substantially L shape in plan view.

10. A circuit breaker as claimed in claim 1 wherein the plunger means comprises a single plunger rod extending through the bore in the armature core.

11. A circuit breaker as claimed in claim 10 wherein the plunger rod is of non-ferrous, preferably plastics material.

12. A circuit breaker as claimed in claim 10 wherein engagement means are provided intermediate the ends of the plunger rod for engagement by the armature core on movement of the armature core in the event of an overcurrent fault occurring from a non-tripping position in which the armature core is retained by a spring biassing means to a tripping position in which current flowing through the coil draws the armature core through the coil against the biassing of the spring means to engage the plunger rod and trip the breaker assembly in the event of an overcurrent fault occurring.

13. A circuit breaker as claimed in claim 12 wherein the engagement means is provided at substantially the mid point along the longitudinal axis of the plunger rod so that the rod is substantially symmetrical.

14. A circuit breaker as claimed in claim 12 wherein the engagement means comprises a radially outwardly extending collar engagable in a complementary shaped recess in the armature core.

15. A circuit breaker as claimed in claim 13 wherein the plunger rod is slidably mounted in a bushing provided in the coil at the end thereof remote from the armature core.

16. A circuit breaker as claimed in claim 1 wherein the actuating device comprises a solenoid.

17. A circuit breaker as claimed in claim 1 wherein the actuating device is operated from a remote location.

18. A circuit breaker as claimed in claim 1 wherein position sensing means are provided for sensing the position of the plunger means.

19. A circuit breaker as claimed in claim 18 wherein the position sensing means comprises switch means operated by the plunger means on movement between the non-tripped and tripped position.

* * * * *